US008333468B2

(12) United States Patent
Laaspere et al.

(10) Patent No.: US 8,333,468 B2
(45) Date of Patent: Dec. 18, 2012

(54) METHOD OF PRINTING

(75) Inventors: Jaan Thomas Laaspere, Norwich, VT (US); James R. Freedman, Newton Centre, MA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 1085 days.

(21) Appl. No.: 11/850,268

(22) Filed: Sep. 5, 2007

(65) Prior Publication Data

US 2009/0058971 A1 Mar. 5, 2009

(51) Int. Cl.
*B41J 2/01* (2006.01)

(52) U.S. Cl. ..... 347/107

(58) Field of Classification Search ..... None
See application file for complete search history.

(56) References Cited

U.S. PATENT DOCUMENTS

| | | | | |
|---|---|---|---|---|
| 5,916,667 | A | 6/1999 | Castle | |
| 6,178,006 | B1 * | 1/2001 | Pagan | 358/1.3 |
| 2006/0221145 | A1 | 10/2006 | Graveson et al. | |
| 2006/0249039 | A1 * | 11/2006 | Feldman et al. | 101/115 |

FOREIGN PATENT DOCUMENTS

| | | | |
|---|---|---|---|
| EP | 0737572 | B2 | 10/1996 |
| EP | 1707376 | A3 | 10/2007 |
| JP | 2001232744 | A | 8/2001 |
| JP | 2002361833 | A | 12/2002 |
| JP | 2003-306888 | A | 10/2003 |
| JP | 2003326667 | | 11/2003 |
| JP | 200474432 | A | 3/2004 |
| JP | 2004066673 | | 3/2004 |
| JP | 2005144790 | | 6/2005 |
| JP | 2005-256237 | A | 9/2005 |
| JP | 2006-124466 | A | 5/2006 |

OTHER PUBLICATIONS

International Search Report and Written Opinion dated Jan. 5, 2009.
Japanese Office Action dated Jul. 20, 2011.
CN Second Office Action issued Dec. 23, 2011 in Chinese application No. 200880105521, 6 pages.
Chinese First Office Action for Application No. 200880105552.1, dated Jul. 6, 2011, 8 pages.
Japanese Office Action Translation for Application No. JP 2010-523313, mailed May 23, 2012.
International Preliminary Report on Patentability for PCT/EP2008/007133, issued Mar. 9, 2010, 6 pages.

* cited by examiner

*Primary Examiner* — Matthew Luu
*Assistant Examiner* — Kendrick Liu
(74) *Attorney, Agent, or Firm* — Fish & Richardson P.C.

(57) ABSTRACT

A method of printing an image on a substrate in a printing machine having at least a first printing unit and an inkjet printing unit, includes moving the substrate through the printing machine. A raster image formed of image dots is printed on the substrate at a first moment using at least the first printing unit. At least one contiguous area of inkjet dots in the raster image is printed at a second moment, after the first moment, using the inkjet printing unit. Substantially all inkjet dots forming the contiguous area are printed at dot locations having similar surface wetting properties.

16 Claims, 3 Drawing Sheets

METHOD OF PRINTING

BACKGROUND OF THE INVENTION

Field of the Invention

The invention relates to a method of printing an image on a substrate in a printing machine including at least a first printing unit and an inkjet printing unit.

It has become more and more popular to create print products in a combination of several different printing process technologies, in order to take advantage of special capabilities or properties of the mutually different printing methods. For example, ink jet technology is frequently used for imprinting variable information into static images printed by offset or flexographic printing. Typical print products in such applications might be labels or packaging. In other examples, special visual effects can only be achieved in combined printing.

When ink-jet imprinting is performed as usual into a blank space of a static background image, e.g. onto an unaffected surface of the printing material, the process is rather uncritical. However, it has been discovered in experiments that problems can arise in a situation in which ink is jetted onto a pre-printed printing material. A difference in spread characteristics of ink for inkjet printing on certain papers, notably gloss papers, and pre-printed offset ink, has been observed. A differential spread of ink on a heterogeneous surface can cause serious, in particular visible image quality defects, when ink is jetted on partially pre-printed (ink-covered) areas of a substrate, for instance a raster image area.

SUMMARY OF THE INVENTION

It is accordingly an object of the invention to provide a method of printing, which overcomes the hereinafore-mentioned disadvantages of the heretofore-known methods of this general type and which avoids quality defects in images which are partially printed by using ink jet ink on a substrate that is partially already covered by ink.

The technical problem to solve is the avoidance or the correction of differential spread of ink jet ink on preprinted ink, in particular offset or flexographic ink, on a substrate.

With the foregoing and other objects in view there is provided, in accordance with the invention, a method of printing an image on a substrate or a printing material in a printing machine including at least a first printing unit and an inkjet printing unit. In the method, at least the following steps are performed: The substrate is moved through the printing machine. A raster image formed of image dots is printed on the substrate at a first moment using at least the first printing unit. At least one contiguous area of inkjet dots in the raster image is printed at a second moment, after the first moment, using the inkjet printing unit, whereby substantially all inkjet dots forming the contiguous area are printed at dot locations having similar surface wetting properties. Expressed differently, all inkjet dots in a set of contiguous inkjet dots which are significant for the perception of the shape (or form or appearance) of the contiguous area are printed into the area of the raster image at dot locations having similar surface wetting properties at a second moment, after the first moment, using the inkjet printing unit. In still other words, a or at least one set of contiguous inkjet dots is printed into the area of the raster image, only at dot locations having the same surface wetting property, at a second moment after the first moment, using the inkjet printing unit.

The printing machine can be an offset printing machine, a flexographic printing machine or a printing machine capable of executing both offset printing and flexographic printing. The raster image can be a halftone image. The set of contiguous inkjet dots can form a line or a full-coverage area of ink. The area of the set of contiguous inkjet dots can have at least one extension of greater length than the intra-dot distance between neighboring dots of the raster image. Similar surface wetting properties are alike or like one another. Identical surface wetting properties are also similar. The surface wetting properties can be comparable or matching. Similar surface wetting properties can be similar (e.g. different, but not identical) or substantially the same surface wetting properties in an interval of measurement errors or acceptable discrepancies or differences. In particular, they can be exactly the same or identical surface wetting properties. Discrepancies or differences can be acceptable if they do not play a role in the printing process or for the perception of the printed product by the human eye. The inkjet ink can be colorful, in particular it can be black. The surface wetting property can be the hydrophilicity or the hydrophobicity, for instance a (quantitative) measure for its degree. The raster image can be a multicolor image, in particular a CMYK-standard color image. The raster can be a frequency modulated raster. The substrate can be in the form of a sheet (preferred) or in the form of a web. The substrate can be one of a group including paper, cardboard, carton and polymer foil.

In accordance with a first mode of the invention, the inkjet dots are printed at locations not overlapping with the image dots of the raster image. Inkjet dots are only printed between raster image dots. More precisely, the positions of the inkjet dots can be chosen as a function of the positions of the image dots of the raster image.

In accordance with a second mode of the invention, the method includes at least the additional step of generating raster image data, with the raster dot positions of the raster image being chosen as a function of the inkjet dot positions for avoiding overlap between raster dots and inkjet dots. For instance, this can be achieved by adjusting the raster screening algorithm of the raster image print to eliminate regular patterns of raster dots which can cause periodic and therefore more visible errors. One specific approach includes the use of a frequency modulated raster screen instead of a conventionally used amplitude modulated one. In addition, the maximum spot size is controlled to be small enough to minimize interaction with the inkjet-printed ink. As a further measure, the screen angle of the raster, in amplitude modulated raster screens, can be also changed or varied.

In accordance with a third mode of the invention, the method includes at least the additional step of covering the raster image by a coating to produce a full coverage area after the first moment, e.g. after raster image printing, and before the second moment, e.g. before ink-jetting. The coating can be a colorless and/or clear varnish. The gloss of the coating can be matched to the gloss of the substrate. The coating can be applied to the substrate using a contact transfer method.

In accordance with a fourth mode of the invention, the inkjet dots are printed only at sub-areas of the raster image featuring full coverage of ink. For example, this can be achieved by printing full coverage in sub-areas using a lower density ink instead of a raster image with the same color perception, whenever inkjet printing will take place, in order to eliminate the variation in spreading. For example, if the desired final image involves black variable inkjet-printed text on light blue background, the light blue is printed as a 100% coverage instead of printing a partial coverage of full density cyan and magenta ink.

The distinctive characteristics of the four mentioned embodiments might be used separately or in combination in actual embodiments in practice.

In accordance with another mode of the invention, the raster image can be printed by using a contact printing process. In particular, the raster image can be printed by using an offset printing process (preferred) or a flexographic printing process. The at least first printing unit can include a printing plate or a printing master.

In accordance with a further mode of the invention, the inkjet dots can be printed only at ink-covered or at ink-free locations.

In accordance with an added mode of the invention, in concretely realized embodiments of the method, it is preferred to use an inkjet printing unit which includes at least one drop-on-demand inkjet printing module. The inkjet printing unit can be suitable for multicolor printing.

In accordance with an additional mode of the invention, all inkjet dots can be printed only at locations having the same surface wetting property.

With the objects of the invention in view, there is also provided a substrate featuring an image obtained by executing the method, with limitations or combinations of limitations as disclosed in this specification.

Other features which are considered as characteristic for the invention are set forth in the appended claims.

Although the invention is illustrated and described herein as embodied in a method of printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
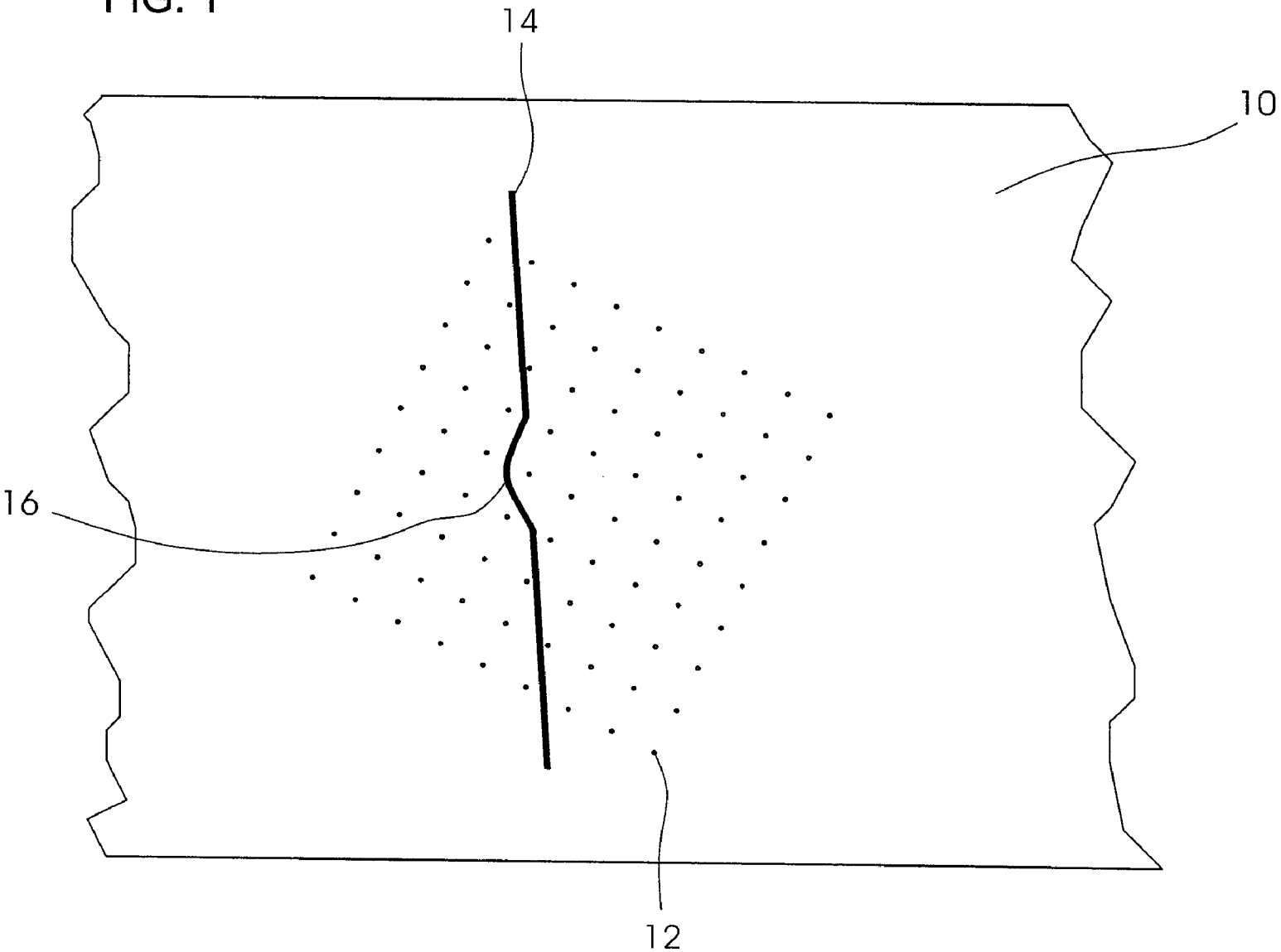
FIG. 1 is a fragmentary, diagrammatic, plan view of a substrate, showing an image defect occurring in overprinting an area of offset-printed raster dots by an inkjet line.

Referring now to the figures of the drawings in detail and first, particularly, to FIG. 1 thereof, there is seen a diagrammatic representation of a magnified example of a printed area on a substrate 10, without taking advantage of the invention, in order to demonstrate the technical problem to overcome. The area features a regular or amplitude modulated offset-printed raster 12 leaving some space of ink-free surface between individual raster image dots. When an inkjet-printed line 14 is printed in the form of individual but contiguous inkjet dots, an image defect 16 is observed. The inkjet-printed line is distorted due to the differential spread between ink-covered and ink-free locations in the raster image area. In other words, the inkjet ink spreads onto the ink-free surface of the substrate 10 or moves away from the preprinted raster image dots of the offset-printed raster 12. The differential spread in a halftone image can yield a repeating irregularity at a spatial frequency visible to the eye.

Figure 2:
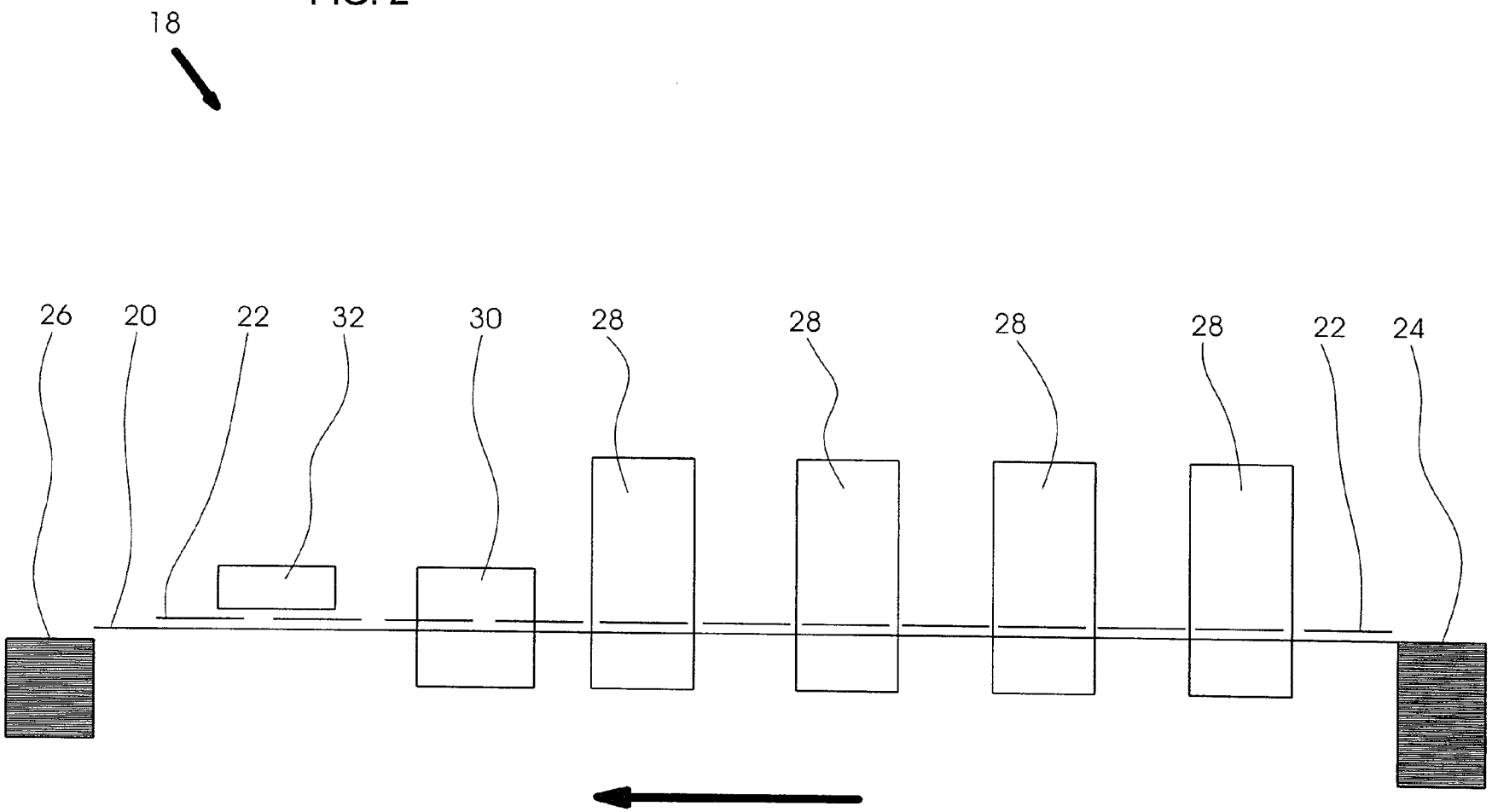
FIG. 2 is a longitudinal-sectional view of a printing machine suitable for performing a preferred embodiment of the method according to the invention.

FIG. 2 is a diagrammatic view of a printing machine 18 suitable for performing a preferred embodiment of the method according to the invention. Sheets of substrates 22, notably paper sheets, are moved through the printing machine 18 along a transport path 20. In a concrete embodiment, the transport path 20 can be curved or wound around cylinder surfaces. The sheets can be gripped and passed on from transport device to transport device, for instance from cylinder to cylinder. The sheets of substrates 22 are individualized in a feeder from a pile 24 for feeding and stacked into a pile 26 for delivery in a delivery of the printing machine 18. The embodiment of the printing machine 18 shown in FIG. 2 has four offset printing units 28, e.g. is capable of multicolor printing using the four standard colors cyan (C), magenta (M), yellow (Y), and black (B). The sheets of substrates 22 pass through the printing units 28 and receive a four-color raster image on one of their surfaces. Along the transport path 20, the printing units 28 are followed by a coating unit 30 capable of applying a varnish to the four-color raster printed surface of the sheets of substrates 22. Eventually, inkjet printing is performed in an inkjet printing unit 32.

A uniform offset-printed background area for the inkjet printing is created in the coating unit 30 to provide a homogeneous surface. The surface is homogeneous at least in the sense that the local differences in the surface wetting properties are so small that their influence on the inkjet ink-spread can be safely neglected. The homogeneous surface is obtained by a clear varnish coating applied in the coating unit 30 of the printing machine 18, at least in locations where inkjet printing will be carried out. Although there is complexity added to the offset print job with respect to the situation shown in FIG. 1, a single varnish type can be used in this approach for all offset jobs. Different varnishes are needed to match a specific gloss of the underlying substrate to make the coating less visible. Furthermore, the varnish can be adapted to have good sticking properties for the inkjet ink. In a refinement of this embodiment, the background area covered by the varnish is used to provide positive visual effects as a differential gloss.

Figure 3:
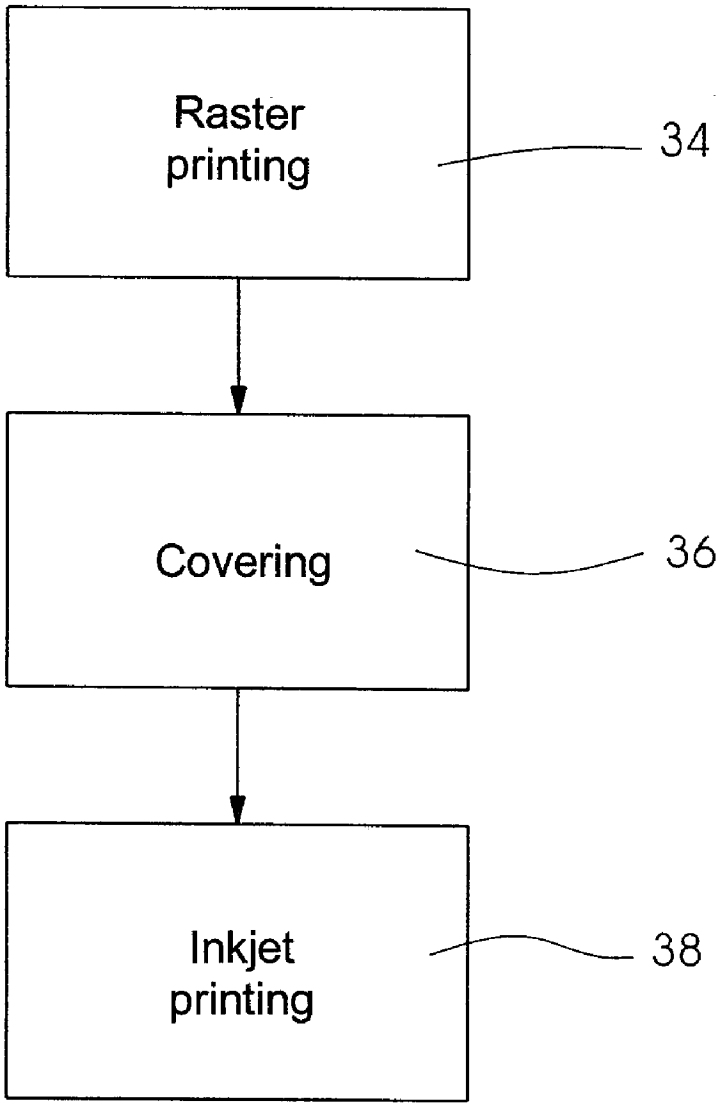
FIG. 3 is a block diagram illustrating the steps executed in the preferred embodiment of the method.

FIG. 3 refers to the steps executed in the preferred embodiment of the method explained in conjunction with FIG. 2. The method is executed on substrates being moved through a printing machine 18 along a transport path 22. In a first step, a raster printing step 34, a multicolor raster image formed of image dots is printed on the substrate using four offset printing units 28. After that, in a second step, a covering step 36, the raster image is covered by a coating of a colorless and clear varnish to produce a full coverage area, using the coating unit 30. After that, in a third step, an inkjet printing step 38, a set of contiguous inkjet dots is printed into the area of the raster image using the inkjet printing unit 32. The area has obtained the same surface wetting property at ink-covered locations and at ink-free locations due to the varnish applied both to the ink-covered and ink-free parts of the raster image.

The invention claimed is:

1. A method of printing an image on a substrate in a printing machine having at least a first printing unit and an inkjet printing unit, the method comprising the following steps:

moving the substrate through the printing machine;

printing a raster image of image dots on the substrate at a first moment using at least the first printing unit; and printing at least one contiguous area of inkjet dots in the same printed area as the raster image at a second moment after the first moment, the contiguous area of inkjet dots being printed using the inkjet printing unit, substantially all of the inkjet dots of the contiguous area being formed at dot locations that have similar surface wetting properties and that do not overlap with the image dots of the raster image, at least some of the inkjet dots each being formed at a location between two adjacent image dots that are separated by a smallest distance among all distances between any two of the image dots of the raster image.

2. The method according to claim 1, wherein the dot locations have identical surface wetting properties.

3. The method according to claim 1, further comprising generating raster image data having positions of the image dots chosen as a function of positions of the inkjet dots, for avoiding overlap between the image dots and the inkjet dots.

4. The method according to claim 1, which further comprises printing the inkjet dots only at sub-areas of the raster image featuring full coverage of ink.

5. The method according to claim 1, which further comprises printing the raster image using a contact printing process.

6. The method according to claim 1, wherein the at least first printing unit includes a printing plate or a printing master.

7. The method according to claim 1, which further comprises printing the raster image using an offset printing process or a flexographic printing process.

8. The method according to claim 1, which further comprises printing the inkjet dots only at ink-covered or at ink-free locations.

9. The method according to claim 1, wherein the raster is a frequency modulated raster.

10. The method according to claim 1, wherein the substrate is in the form of a sheet.

11. The method according to claim 1, which further comprises selecting the substrate from the group consisting of paper, cardboard, carton and polymer foil.

12. The method according to claim 1, wherein the inkjet printing unit includes at least one drop-on-demand inkjet printing module.

13. The method according to claim 1, wherein the surface wetting property is hydrophilicity.

14. The method according to claim 1, which further comprises printing all of the inkjet dots only at locations having the same surface wetting property.

15. The method according to claim 1, wherein the raster image is a multicolor image.

16. A substrate, comprising an image obtained by executing the method according to claim 1.

* * * * *

UNITED STATES PATENT AND TRADEMARK OFFICE

CERTIFICATE OF CORRECTION

PATENT NO. : 8,333,468 B2
APPLICATION NO. : 11/850268
DATED : December 18, 2012
INVENTOR(S) : Laaspere et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1324 days.

Signed and Sealed this
Eleventh Day of November, 2014

Michelle K. Lee

Michelle K. Lee
*Deputy Director of the United States Patent and Trademark Office*